US012065622B2

(12) United States Patent
De Feo et al.

(10) Patent No.: US 12,065,622 B2
(45) Date of Patent: Aug. 20, 2024

(54) AMMONIUM-BASED IONIC LIQUID AND ITS USE AS A LUBRICANT ADDITIVE

(71) Applicant: TOTALENERGIES ONETECH, Courbevoie (FR)

(72) Inventors: Modestino De Feo, Solaize (FR); Vanessa Pichon, Solaize (FR); Thomas Schubert, Bad Wimpfen (DE); Boyan Iliev, Heilbronn (DE)

(73) Assignee: TOTALENERGIES ONETECH, Courbevoie (FR)

( * ) Notice: Subject to any disclaimer, the term of this patent is extended or adjusted under 35 U.S.C. 154(b) by 31 days.

(21) Appl. No.: 17/919,342

(22) PCT Filed: Apr. 7, 2021

(86) PCT No.: PCT/EP2021/059086
§ 371 (c)(1),
(2) Date: Oct. 17, 2022

(87) PCT Pub. No.: WO2021/209296
PCT Pub. Date: Oct. 21, 2021

(65) Prior Publication Data

US 2023/0159846 A1 May 25, 2023

(30) Foreign Application Priority Data

Apr. 16, 2020 (EP) ..... 20315181

(51) Int. Cl.

| | |
|---|---|
| ***C10M 133/06*** | (2006.01) |
| ***C10M 169/04*** | (2006.01) |
| *C10N 20/00* | (2006.01) |
| *C10N 30/00* | (2006.01) |
| *C10N 30/02* | (2006.01) |
| *C10N 30/04* | (2006.01) |
| *C10N 30/12* | (2006.01) |
| *C10N 40/25* | (2006.01) |

(52) U.S. Cl.
CPC ..... *C10M 133/06* (2013.01); *C10M 169/04* (2013.01); *C10M 2207/262* (2013.01); *C10M 2215/04* (2013.01); *C10N 2020/077* (2020.05); *C10N 2030/02* (2013.01); *C10N 2030/04* (2013.01); *C10N 2030/12* (2013.01); *C10N 2030/52* (2020.05); *C10N 2040/252* (2020.05)

(58) Field of Classification Search
CPC ..... C10M 133/06; C10M 169/04; C10M 2207/262; C10M 2215/04; C10N 2020/077; C10N 2030/02; C10N 2030/04; C10N 2030/12; C10N 2030/52; C10N 2040/252
See application file for complete search history.

(56) References Cited

U.S. PATENT DOCUMENTS

| | | | | |
|---|---|---|---|---|
| 10,351,791 | B2 * | 7/2019 | Reid | C10L 1/232 |
| 2004/0219372 | A1 | 11/2004 | Ogihara et al. | |
| 2010/0029519 | A1 * | 2/2010 | Schwab | C11D 1/62 508/110 |
| 2010/0084597 | A1 * | 4/2010 | Schwab | C10M 171/004 508/528 |
| 2010/0093577 | A1 * | 4/2010 | Ritchie | C10M 141/08 508/429 |
| 2012/0178658 | A1 | 7/2012 | Tredget | |
| 2016/0024421 | A1 | 1/2016 | Qu et al. | |
| 2016/0304804 | A1 * | 10/2016 | Boesmann | C23F 11/167 |
| 2017/0009172 | A1 * | 1/2017 | Bender | C07C 59/125 |
| 2017/0218291 | A1 * | 8/2017 | Reid | C07C 53/10 |
| 2019/0002783 | A1 * | 1/2019 | Gill | C10M 129/10 |
| 2022/0033423 | A1 * | 2/2022 | Qu | C07F 9/5463 |

FOREIGN PATENT DOCUMENTS

| | | | |
|---|---|---|---|
| JP | 2002-265856 | A | 9/2002 |
| WO | 2015/140822 | A1 | 9/2015 |
| WO | 2019/229173 | A1 | 12/2019 |

OTHER PUBLICATIONS

Mar. 31, 2023 Office Action issued in Chinese Patent Application No. 202180028428.5.
Jul. 9, 2021 International Search Report issued in International Patent Application No. PCT/EP2021/059086.
Jul. 9, 2021 Written Opinion issued in International Patent Application No. PCT/EP2021/059086.
Rivera et al., "Tribological performance of three fatty acid anion-based ionic liquids (FAILs) used as lubricant additive", Journal of Molecular Liquids, Elsevier, vol. 296, Oct. 7, 2019.
Oulego et al., "Relationships between the physical properties and biodegradability and bacteria toxicity of fatty acid-based ionic liquids", Journal of Molecular Liquids, Elsevier, vol. 292, Jul. 26, 2019.

* cited by examiner

*Primary Examiner* — Ellen M McAvoy
(74) *Attorney, Agent, or Firm* — Oliff PLC

(57) ABSTRACT

An ammonium-based ionic liquid compound including a tri-n-octylmethylammonium cation and a carboxylate anion. A lubricant composition including it, and its use as a detergent and/or anti-corrosion additive in a lubricant, in particular a marine lubricant.

13 Claims, No Drawings

AMMONIUM-BASED IONIC LIQUID AND ITS USE AS A LUBRICANT ADDITIVE

FIELD OF THE INVENTION

The invention relates to an ammonium-based ionic liquid. In particular, the invention relates to an ammonium-based ionic liquid that can be used as lubricant additive in a lubricant composition, in particular for marine engines. It also relates to a lubricant composition comprising said ammonium-based ionic liquid.

BACKGROUND OF THE INVENTION

One of the primary functions of lubricants is to decrease friction. Frequently, however, lubricating oils need additional properties to be used effectively. For example, lubricants used in large diesel engines, such as, for example, marine diesel engines, are often subjected to operating conditions requiring special considerations.

The marine oils used in low-speed two-stroke crosshead engines are of two types. On the one hand, cylinder oils ensuring the lubrication of the cylinder-piston assembly and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; these are in particular sulphur oxides ($SO_2$, $SO_3$), which are then hydrolysed in contact with the moisture present in the combustion gases and/or in the oil. This hydrolysis generates sulphurous ($HSO_3$) or sulphuric ($H_2SO_4$) acid. These acids tend to condense in the engine, so it can corrode the metal or wipe out major parts such as joints or lining parts.

To protect the surface of piston liners and avoid excessive corrosive wear, these acids must be neutralized, which is generally done by reaction with the basic sites included in the lubricant.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a fuel oil, the higher the BN of a marine oil needs to be. This is why marine oils with a BN varying from 5 to 140 mg KOH/g are found on the market.

This basicity is generally provided by detergents that are neutral and/or overbased by insoluble metallic salts, in particular metallic carbonates. The detergents, mainly of anionic type, are for example metallic soaps of salicylate, phenate, sulphonate, carboxylate type etc, which form micelles where the particles of insoluble metallic salts are maintained in suspension. The usual neutral detergents intrinsically have a BN typically less than 150 mg KOH per gram of detergent and the usual overbased detergents intrinsically have a BN in a standard fashion comprised between 150 and 700 mg KOH per gram of detergent. Their percentage by mass in the lubricant is fixed as a function of the desired BN level.

Currently, in the presence of fuel oils with a high sulphur content (3.5% w/w and less), marine lubricants having a BN from 70 to 140 are used. In the presence of fuel oils with a low sulphur content (0.5% w/w), marine lubricants having a BN from 10 to 70 are used. In these two cases, a sufficient neutralizing capacity is achieved as the necessary concentration in basic sites provided by the neutral and/or the overbased detergents of the marine lubricant is reached.

There is a need for a marine detergent, which is able to be used in presence of high-sulphur fuels and also low-sulphur fuels and having a good neutralization capacity of sulfuric acid while maintaining a good thermal resistance and thus a lower risk of deposits formation in the hot section of the engine.

There is also a need for a marine detergent, which is able to be used in presence of high-sulphur fuels and also low-sulphur fuels and having good anti-corrosion properties.

There is a need for a marine detergent, which is able to be used in presence of high-sulphur fuels and also low-sulphur fuels, respectively having a BN from 70 to 140 and having a BN from 10 to 70, and having a good neutralization capacity of sulfuric acid while maintaining a good thermal resistance and thus a lower risk of deposits formation in the hot section of the engine.

There is a need for a marine detergent, which is able to be used in presence of high-sulphur fuels and also low-sulphur fuels, respectively having a BN from 70 to 140 and having a BN from 10 to 70, and having good anti-corrosion properties.

There is also a need for marine lubricants having improved detergency properties: the capacity to keep the engine clean by limiting deposits ("keep-clean" effect) or by reducing the deposits already present in the internal parts of the combustion engine ("clean-up" effect).

An object of the present invention is to provide a lubricant additive overcoming all or part of the aforementioned drawbacks. Another object of the present invention is to provide a lubricant additive whose formulation within lubricant compositions is easy to implement.

Another object of the present invention is to provide a method for lubricating a marine engine, and especially for lubricating a two-stroke marine engine and which can be used with both low-sulphur fuel and high-sulphur fuel.

Another object of the present invention is to provide a method for lubricating a marine engine, and especially for a two-stroke marine engine used with very low-sulphur fuel.

Another object of the present invention is to provide a method for reducing the formation of deposits in the hot section of a marine engine, notably of a two-stroke marine engine.

Document EP 2403930 discloses a composition of an oil-soluble ionic detergent comprising a quaternary non-metallic pnictogen cation and an organic anion having at least one hydrocarbyl group of sufficient length to impart oil solubility to the detergent. The detergent has a total base number (TBN) to total acid number (TAN) ratio of at least 2:1 imparts ash-free basicity to a lubricant composition.

WO 2008/075016 discloses ionic liquids, wherein the cation is a quaternary phosphonium or quaternary ammonium cation, and the anion is selected from phosphinates, sulfosuccinates and carboxylates. The ionic liquids according to this disclosure may be used as an anti-wear or friction modifier additives in a lubricating oil composition.

US 2012/178658 discloses lubricating compositions comprising: (i) from 50% to 99% by weight of base oil; (ii) from 0.01% to 5% by weight of ionic liquid; and (iii) from 0.01% to 10% by weight of additives. The lubricating compositions are suitable for use in turbine engine oils.

N. Rivera et al. (*Journal of Molecular Liquids,* 296, 2019, 111881) discloses ammonium-based ionic liquids and their tribological behavior, in particular their friction properties. P. Oulego et al. (*Journal of Molecular Liquids,* 292, 2019, 111451) studied the correlation between the physical properties and the biodegradability and the bacteria toxicity of the same ionic liquids. These documents fail to disclose the use of these ionic liquids as detergent additives in lubricating compositions.

JP 2002265856 discloses a composition comprising a vinyl polymer, a polyisocyanate compound and a quaternary ammonium carboxylate useful for various coating materials and construction and building materials.

US 2004/219372 discloses a composition comprising a siloxane polymer and a quaternary ammonium salt useful for forming porous films having improved dielectric properties, adhesiveness and mechanical strength.

Surprisingly, the Applicant has discovered that ammonium-based ionic liquids of formula (I) as defined hereunder have noteworthy properties as detergent additive in lubricant composition for marine engines, particularly for two-stroke marine engines. The ionic liquids used according to the invention in these lubricant compositions can keep the engine clean, in particular by limiting or preventing the formation of deposits ("keep-clean" effect) or by reducing the deposits already present in the internal parts of the combustion engine ("clean-up" effect).

The applicant also discovered that that ammonium-based ionic liquids of formula (I) described hereunder have noteworthy properties as anti-corrosive additives in lubricant composition for marine engines, particularly for two-stroke marine engines.

SUMMARY OF THE INVENTION

The invention is directed to the use of the ammonium-based ionic liquid of formula (I) described below as detergent in a lubricant composition, preferably a marine lubricant, to reduce and/or limit and/or prevent and/or delay the formation of deposits or to reduce the deposits already present in the internal parts of a combustion engine.

The ammonium-based ionic liquid compound responds to formula (I)

$$[CAT^+][X^-] \quad (I)$$

wherein $[CAT^+]$ is tri-n-octylmethylammonium and $[X^-]$ is selected from compounds of formula (IA):

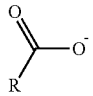

(IA)

wherein R is selected from linear or branched alkyl and alkenyl groups comprising from 2 to 8 atoms of carbon.

Advantageously, R represents a linear or branched alkyl group comprising from 2 to 8 atoms of carbon.

More advantageously, R represents a linear or branched alkyl group comprising from 4 to 8, preferably from 5 to 7 carbon atoms.

According to a favourite embodiment, $[X^-]$ is 2-ethylhexanoate.

The invention is also directed to a lubricant composition comprising:

from 30.0 to 99.95% of at least one base oil, from 0.05 to 15.0% of at least one ammonium-based ionic liquid as defined above, from 1 to 35% weight of neutral and overbased detergents, other than the ionic liquid, having a Total Base Number according to ASTM D2896 of from 20 to 450 mg KOH/g, the percentages being defined by weight of component as compared to the total weight of the composition.

According to a favourite embodiment, the percentage by weight of the ammonium-based ionic liquid as defined above relative to the total weight of lubricant composition is chosen such that the BN provided by the ammonium-based ionic liquid represents at least 3% of the total BN of said lubricant composition.

According to another favourite embodiment, the percentage by weight of ammonium-based ionic liquid of formula (I), relative to the total weight of lubricant composition, is chosen such that the BN provided by these compounds represents a contribution of at least 0.5 milligrams of potash per gram of lubricant, preferably at least 2 milligrams of potash per gram, more preferably at least 3 milligrams of potash per gram to the total BN of said lubricant composition.

According to another favourite embodiment, the lubricant composition has a Total Base Number (TBN) value according to ASTM D2896 of above 5 mg KOH/g.

According to another favourite embodiment, the lubricant composition has a kinematic viscosity at 100° C. superior or equal to 5.6 $mm^2/s$ and inferior or equal to 21.9 $mm^2/s$.

The invention also relates to a lubricant composition comprising:

from 30.0 to 99.95% of at least one base oil, from 0.05 to 15.0% of tri-n-octylmethylammonium 2-ethylhexanoate, the percentages being defined by weight of component as compared to the total weight of the composition.

Preferably, this lubricant composition comprises at least one detergent selected from neutral and overbased detergents, other than the ionic liquid, having a Total Base Number according to ASTM D2896 of from 20 to 450 mg KOH/g.

The invention is also directed to the use of the ammonium-based ionic liquid defined above as anti-corrosion additive in a lubricant composition, notably a marine lubricant.

The invention is also directed to a method for lubricating a two-stroke marine engine and four-stroke marine engines, preferably two-stroke marine engine, said method comprising application to said marine engine of the lubricant compositions as described above.

The invention is also directed to a method to reduce and/or limit and/or prevent and/or delay the formation of deposits or to reduce the deposits already present in the internal parts of a combustion engine, wherein said method comprises at least a step of application to said engine of the above-defined ammonium-based ionic liquid or of the above-described lubricant compositions.

The invention is also directed to a method to reduce and/or eliminate and/or delay the corrosion in the internal parts of a combustion engine, notably a marine engine, wherein said method comprises at least a step of application to said engine of the above-defined ammonium-based ionic liquid or of the above-described lubricant compositions.

The ammonium-based ionic liquid of formula (I) defined above and hereunder greatly improves the detergency properties of a lubricant composition and makes it possible to reduce/eliminate/delay the corrosion of the internal parts of a marine engine.

DETAILED DESCRIPTION OF THE INVENTION

The term "consists essentially of" followed by one or more characteristics, means that may be included in the process or the material of the invention, besides explicitly listed components or steps, components or steps that do not materially affect the properties and characteristics of the invention.

The expression "comprised between X and Y" includes boundaries, unless explicitly stated otherwise. This expression means that the target range includes the X and Y values, and all values from X to Y.

A "ionic liquid" is a salt in the liquid state with organic or inorganic cations and anions. Generally ionic liquids have a melting point below 100° C.

"Alkyl" means a saturated hydrocarbyl chain that can be linear, branched or cyclic.

"Alkenyl" means a hydrocarbyl chain, that can be linear, branched or cyclic and comprises at least one unsaturation, preferably a carbon-carbon double bond.

"Aryl" means an aromatic hydrocarbyl functional group. This functional group can be monocyclic or polycyclic. As examples of an aryl group one can mention: phenyl, naphtalen, anthracen, phenanthren and tetracen.

"Aralkyl" means a hydrocarbyl radical comprising an aromatic hydrocarbon functional group, preferably monocyclic, linked to an alkyl chain, the aralkyl group can be linked to the rest of the molecule through the aryl or the alkyl part of the radical.

"Hydrocarbyl" means a compound or fragment of a compound selected from: an alkyl, an alkenyl, an aryl, an aralkyl. Where indicated, some hydrocarbyl groups include heteroatoms.

The Ammonium-Based Ionic Liquid

Ammonium-based ionic liquid are organic salts composed of organic cations and either organic or inorganic anions. The cation and anion can be varied to obtain an ionic liquid with the desired properties. According to the invention, the ammonium-based ionic liquid, is a salt of an ammonium cation with an organic anion.

The ammonium-based ionic liquid is advantageously selected from compounds of formula (I):

$$[CAT^+][X^-] \quad (I)$$

wherein $[CAT^+]$ represents a tri-n-octylmethylammonium cation:

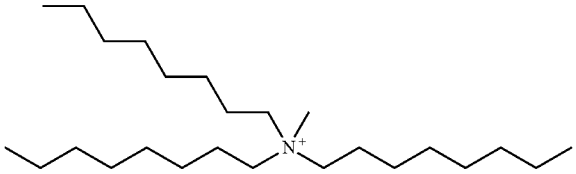

and $[X^-]$ represents one or more anionic species selected from carboxylates of formula (IB):

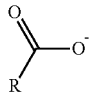

(IB)

wherein R is selected from linear or branched alkyl and alkenyl groups comprising from 2 to 8 atoms of carbon, preferably from 4 to 8 carbon atoms.

Advantageously, $[X^-]$ represents 2-ethylhexanoate.

According to a favourite embodiment, ammonium-based ionic liquid is tri-n-octylmethylammonium 2-ethylhexanoate:

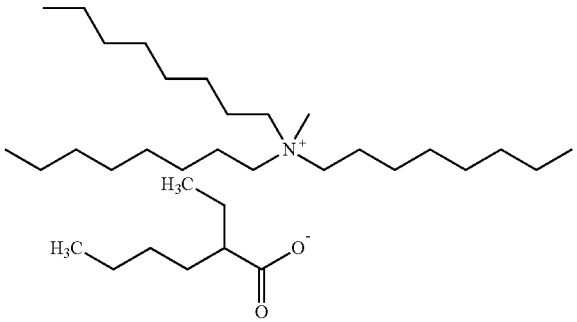

The molecules of formula (I) can be prepared by any method known to the skilled professional, as illustrated for example in M. G. Bogdanov et al., Z. Naturforsch. 2010, 65b, 37-48; Y. Gao et al., Inorg. Chem. 2005, 44, 1704-1712. An example synthesis is disclosed in the experimental part.

In order to be used in a lubricant composition, the ammonium-based ionic liquid of formula (I) must preferably be soluble in a base oil which represents the major part of the lubricant composition. A compound is oil-soluble when it can be solubilized at a concentration of at least 0.01% by weight with regards to the weight of a base oil, at room temperature.

In order to check that the ammonium-based ionic liquid is oil-soluble, a test is disclosed in the experimental part.

Advantageously, the percentage by weight of ammonium-based ionic liquid of formula (I) relative to the total weight of lubricant composition is chosen such that the BN provided by these compounds represents a contribution of at least 0.5 milligrams of potash per gram of lubricant, preferably at least 2 milligrams of potash per gram, more preferably at least 3 milligrams of potash per gram, still more preferably from 3 to 40 milligrams of potash per gram of lubricant, to the total BN of said lubricant composition.

Advantageously, the percentage by weight of ammonium-based ionic liquid of formula (I) relative to the total weight of lubricant composition is chosen such that the alternative BN provided by the ammonium-based ionic liquid represents at least 3%, preferably at least 5%, preferably from 10 to 50% of the total BN of said lubricant composition.

In a preferred embodiment of the invention, the weight percentage of ammonium-based ionic liquid of formula (I) relative to the total weight of the lubricant composition ranges from 0.05 to 15%, preferably from 0.1 to 12%, advantageously from 0.5 to 10%, even more preferably from 1 to 8%.

Lubricant Composition

The invention is also directed to the use of the ammonium-based ionic liquid of formula (I) that has been disclosed above as an additive in lubricating oil (or lubricant) compositions.

The invention is further directed to lubricant compositions for two stroke and four stroke marine engines comprising such additive.

Advantageously, the lubricant composition comprises, preferably consists essentially of:

- from 30.0 to 99.95% of at least one base oil,
- from 0.05 to 15.0% of at least one ammonium-based ionic liquid of formula (I) as defined above,
- the percentages being defined by weight of component as compared to the total weight of the composition.

Even more advantageously, the lubricant composition comprises, preferably consists essentially of:

- from 50.0 to 99.0% of at least one base oil
- from 1.0 to 10.0% of at least one ammonium-based ionic liquid of formula (I) as defined above,
- the percentages being defined by weight of component as compared to the total weight of the composition.

According to another favourite embodiment, the invention is directed to a lubricant composition comprising, preferably consisting essentially of:

- at least one base oil,
- at least one ammonium-based ionic liquid of formula (I) as defined above,
- at least one detergent selected from neutral and overbased detergents having a Total Base Number according to ASTM D2896 of from 20 to 450 mg KOH/g.

Advantageously, according to this embodiment, the lubricant composition comprises, preferably consists essentially of:

- from 30.0 to 94.0% of at least one base oil,
- from 0.05 to 15% of at least one ammonium-based ionic liquid of formula (I) as defined above,
- from 1 to 35% of at least one detergent selected from neutral and overbased detergents having a Total Base Number according to ASTM D2896 of from 20 to 450 mg KOH/g
- the percentages being defined by weight of component as compared to the total weight of the composition.

Advantageously, the lubricant composition comprises, preferably consists essentially of:

- from 50 to 90% of at least one base oil,
- from 1 to 10% of at least one ammonium-based ionic liquid of formula (I) as defined above,
- from 5 to 35% at least one detergent selected from neutral and overbased detergents having a Total Base Number according to ASTM D2896 of from 20 to 450,
- the percentages being defined by weight of component as compared to the total weight of the composition.

Base Oils

Generally, the lubricating oil compositions according to the invention comprise as a first component an oil of lubricating viscosity, also called "base oils". The base oil for use herein can be any presently known or later-discovered oil of lubricating viscosity used in formulating lubricating oil compositions for any of the following applications, e.g., engine oils, marine cylinder oils, functional fluids such as hydraulic oils, gear oils, transmission fluids, like for example automatic transmission fluids, turbine lubricants, trunk piston engine oils, compressor lubricants, metal-working lubricants, and other lubricating oil and grease compositions.

Advantageously, the lubricant compositions according to the invention are marine engine lubricating oil compositions, preferably they are 2-stroke marine engine lubricating oil compositions.

Generally, the oils also called "base oils" used for formulating lubricant compositions according to the present invention may be oils of mineral, synthetic or plant origin as well as their mixtures. The mineral or synthetic oils generally used in the application belong to one of the classes defined in the API classification as summarized below:

| | Saturated substance content (weight percent) | Sulfur content (weight percent) | Viscosity Index |
|---|---|---|---|
| Group 1 Mineral oils | <90% | >0.03% | 80 ≤ VI < 120 |
| Group 2 Hydrocracked oils | ≥90% | ≤0.03% | 80 ≤ VI < 120 |
| Group 3 Hydroisomerized oils | ≥90% | ≤0.03% | ≥120 |
| Group 4 | PAOs | | |
| Group 5 | Other bases not included in the base Groups 1 to 4 | | |

These mineral oils of Group 1 may be obtained by distillation of selected naphthenic or paraffinic crude oils followed by purification of these distillates by methods such as solvent extraction, solvent or catalytic dewaxing, hydrotreating or hydrogenation.

The oils of Groups 2 and 3 are obtained by more severe purification methods, for example a combination of hydrotreating, hydrocracking, hydrogenation and catalytic dewaxing. Examples of synthetic bases of Groups 4 and 5 include poly-alpha olefins, polybutenes, polyisobutenes, alkylbenzenes.

These base oils may be used alone or as a mixture. A mineral oil may be combined with a synthetic oil.

The lubricant compositions of the invention have a viscosity grade of SAE-20, SAE-30, SAE-40, SAE-50 or SAE-60 according to the SAEJ300 classification.

Grade 20 oils have a kinematic viscosity at 100° C. of between 5.6 and 9.3 $mm^2/s$.

Grade 30 oils have a kinematic viscosity at 100° C. of between 9.3 and 12.5 $mm^2/s$.

Grade 40 oils have a kinematic viscosity at 100° C. of between 12.5 and 16.3 $mm^2/s$.

Grade 50 oils have a kinematic viscosity at 100° C. of between 16.3 and 21.9 $mm^2/s$.

Grade 60 oils have a kinematic viscosity at 100° C. of between 21.9 and 26.1 $mm^2/s$.

Preferably, the lubricant composition is a cylinder lubricant.

Advantageously, the quantity of base oil in the lubricant composition of the invention is from 30% to 99.95% by weight relative to the total weight of the lubricant composition, preferably from 40% to 99%, more preferably from 50% to 94%.

Detergents

The ammonium-based ionic liquids as above defined play the role of detergent in the lubricant composition. They have the advantage of permitting the use of lower amounts of metal detergents. Therefore, the ionic liquids used according to the invention give access to compositions which have the capacity to neutralize low-sulfur fuel compositions and high-sulfur fuel compositions, but in both cases they avoid the formation of deposits. According to the invention, ionic liquids are preferentially used in combination with at least one detergent that does not belong to the class of ionic liquids, preferably at least one metal detergent.

Detergents, other than the ammonium-based ionic liquids, are typically anionic compounds containing a long lipophilic hydrocarbon chain and a hydrophilic head, wherein the associated cation is typically a metal cation of an alkali metal or alkaline earth metal. The detergents are preferably selected from alkali metal salts or alkaline earth metal (particularly preferably calcium, magnesium, sodium or barium) salts of carboxylic acids, sulphonates, salicylates, naphthenates, as well as the salts of phenates. These metal salts may contain the metal in an approximately stoichiometric amount relative to the anion group(s) of the detergent. In this case, one refers to non-overbased or "neutral" detergents, although they also contribute to a certain basicity.

These "neutral" detergents typically have a BN measured according to ASTM D2896, of less than 150 mg KOH/g, or less than 100 mg KOH/g, or less than 80 mg KOH/g of detergent. This type of so-called neutral detergent may contribute in part to the total BN of lubricating compositions. For example, neutral detergents are used such as carboxylates, sulphonates, salicylates, phenates, naphthenates of the alkali and alkaline earth metals, for example calcium, sodium, magnesium, barium. When the metal is in excess (amount greater than the stoichiometric amount relative to the anion groups(s) of the detergent), then these are so-called overbased detergents. Their BN is high, higher than 150 mg KOH/g of detergent, typically from 200 to 700 mg KOH/g of detergent, preferably from 250 to 450 mg KOH/g of detergent. The metal in excess providing the character of an overbased detergent is in the form of insoluble metal salts in oil, for example carbonate, hydroxide, oxalate, acetate, glutamate, preferably carbonate. In one overbased detergent, the metals of these insoluble salts may be the same as, or different from, those of the oil soluble detergents. They are preferably selected from calcium, magnesium, sodium or barium. The overbased detergents are thus in the form of micelles composed of insoluble metal salts that are maintained in suspension in the lubricating composition by the detergents in the form of soluble metal salts in the oil. These micelles may contain one or more types of insoluble metal salts, stabilised by one or more types of detergent. The overbased detergents comprising a single type of detergent-soluble metal salt are generally named according to the nature of the hydrophobic chain of the latter detergent. Thus, they will be called a phenate, salicylate, sulphonate, naphthenate type when the detergent is respectively a phenate, salicylate, sulphonate or naphthenate. The overbased detergents are called mixed type if the micelles comprise several types of detergents, which are different from one another by the nature of their hydrophobic chain. The overbased detergent and the neutral detergent may be selected from carboxylates, sulphonates, salicylates, naphthenates, phenates and mixed detergents combining at least two of these types of detergents. The overbased detergent and the neutral detergent include compounds based on metals selected from calcium, magnesium, sodium or barium, preferably calcium or magnesium. The overbased detergent may be overbased by metal insoluble salts selected from the group of carbonates of alkali and alkaline earth metals, preferably calcium carbonate. The lubricating composition may comprise at least one overbased detergent and at least a neutral detergent as defined above.

Advantageously, the composition according to the invention comprises from 1 to 35% weight detergent, more advantageously from 5 to 35%, preferably from 8 to 35%, and even more preferably from 10 to 35%, these percentages being by weight of detergent, other than the ionic liquid, with regards to the total weight of the lubricant composition.

Preferably the composition according to the invention comprises from 1 to 35% weight detergent, more advantageously from 5 to 35%, preferably from 8 to 35%, and even more preferably from 10 to 35%, these percentages being by weight of neutral and overbased detergent, with regards to the total weight of the lubricant composition, preferably selected from neutral and overbased detergents having a Total Base Number according to ASTM D2896 of from 20 to 450 mg KOH/g.

Advantageously, the percentage by weight of neutral and overbased detergents relative to the total weight of lubricant is chosen such that the BN provided by the neutral and overbased detergents represents a contribution of at most 70 milligrams of potash per gram of lubricant, preferably from 5 to 70 milligrams of potash per gram of lubricant, more preferably from 20 to 40 milligrams of potash per gram of lubricant, to the total BN of said cylinder lubricant.

Additives:

It is optionally possible to substitute the above-described base oils in full or in part by one or more thickening additives whose role is to increase both the hot and cold viscosity of the composition, or by additives improving the viscosity index (VI).

The lubricant composition of the invention may comprise at least one optional additive, chosen in particular from among those frequently used by persons skilled in the art.

In one embodiment, the lubricant composition further comprises an optional additive chosen amongst an anti-wear additive, an oil soluble fatty amine, a polymer, a dispersing additive, an anti-foaming additive or a mixture thereof.

Polymers are typically polymers having a low molecular weight of from 2000 to 50 000 Dalton ($M_n$). The polymers are selected amongst PIB (of from 2000 Dalton), polyacrylates or polymetacrylates (of from 30 000 Dalton), olefin copolymers, olefin and alpha-olefin copolymers, EPDM, polybutenes, poly alpha-olefin having a high molecular weight (viscosity 100° C.>150), hydrogenated or non-hydrogenated styrene-olefin copolymers.

Anti-wear additives protect the surfaces from friction by forming a protective film adsorbed on these surfaces. The most commonly used is zinc dithiophosphate or ZnDTP. Also in this category, there are various phosphorus, sulphur, nitrogen, chlorine and boron compounds. There are a wide variety of anti-wear additives, but the most widely used category is that of the sulphur phospho additives such as metal alkylthiophosphates, especially zinc alkylthiophosphates, more specifically, zinc dialkyl dithiophosphates or ZnDTP. The preferred compounds are those of the formula $Zn((SP(S)(OR_1)(OR_2))_2$, wherein $R_1$ and $R_2$ are alkyl groups, preferably having 1 to 18 carbon atoms. The ZnDTP is typically present at levels of about 0.1 to 2% by weight relative to the total weight of the lubricating composition. The amine phosphates, polysulphides, including sulphurised olefins, are also widely used anti-wear additives. One also optionally finds nitrogen and sulphur type anti-wear and extreme pressure additives in lubricating compositions, such as, for example, metal dithiocarbamates, particularly molybdenum dithiocarbamate. Glycerol esters are also anti-wear additives. Mention may be made of mono-, di- and trioleates, monopalmitates and monomyristates. In one embodiment, the content of anti-wear additives ranges from 0.01 to 6%, preferably from 0.1 to 4% by weight relative to the total weight of the lubricating composition.

Dispersants are well known additives used in the formulation of lubricating compositions, in particular for application in the marine field. Their primary role is to maintain in suspension the particles that are initially present or appear in the lubricant during its use in the engine. They prevent their agglomeration by playing on steric hindrance. They may also have a synergistic effect on neutralisation. Dispersants used as lubricant additives typically contain a polar group, associated with a relatively long hydrocarbon chain, generally containing 50 to 400 carbon atoms. The polar group typically contains at least one nitrogen, oxygen, or phosphorus element. Compounds derived from succinic acid are particularly useful as dispersants in lubricating additives. Also used are, in particular, succinimides obtained by condensation of succinic anhydrides and amines, succinic esters obtained by condensation of succinic anhydrides and alcohols or polyols. These compounds can then be treated with various compounds including sulphur, oxygen, formaldehyde, carboxylic acids and boron-containing compounds or zinc in order to produce, for example, borated succinimides or zinc-blocked succinimides. Mannich bases, obtained by polycondensation of phenols substituted with alkyl groups, formaldehyde and primary or secondary amines, are also compounds that are used as dispersants in lubricants. In one embodiment of the invention, the dispersant content may be greater than or equal to 0.1%, preferably 0.5 to 2%, advantageously from 1 to 1.5% by weight relative to the total weight of the lubricating composition. It is possible to use a dispersant from the PIB succinimide family, e.g., boronated or zinc-blocked.

Other optional additives may be chosen from defoamers, for example, polar polymers such as polydimethylsiloxanes, polyacrylates. They may also be chosen from antioxidant and/or anti-rust additives, for example organometallic detergents or thiadiazoles. These additives are known to persons skilled in the art. These additives are generally present in a weight content of 0.01 to 5% based on the total weight of the lubricating composition.

In one embodiment, the lubricant composition according to the invention may further comprise an oil soluble fatty amine.

The optional additives such as defined above contained in the lubricant compositions of the present invention can be incorporated in the lubricant composition as separate additives, in particular through separate addition thereof in the base oils. However, they may also be integrated in a concentrate of additives for marine lubricant compositions.

Method for Producing a Lubricant Composition

The present disclosure provides a method for producing a lubricant composition, notably a marine lubricant, as disclosed above, comprising the step of mixing the base oil with the ammonium-based ionic liquid component of formula (I), and optionally the additives.

Properties of the Lubricant Composition

The components that have been above-disclosed are formulated to provide a composition that advantageously has the following characteristics:

Advantageously, the composition has a Total Base Number (TBN) value according to ASTM D2896 of above 5 mg KOH/g. Preferably, the composition has a Total Base Number (TBN) value of from 10 to 140 mg KOH/g, better from 15 to 75 mg KOH/g, more preferably from 20 to 60 mg KOH/g.

Preferably, the lubricant composition according to the invention has a kinematic viscosity at 100° C. superior or equal to 5.6 $mm^2/s$ and inferior or equal to 21.9 $mm^2/s$, preferably superior or equal to 12.5 $mm^2/s$ and inferior or equal to 21.9 $mm^2/s$, more preferably superior or equal to 14.3 $mm^2/s$ and inferior or equal to 21.9 $mm^2/s$, advantageously comprised between 16.3 and 21.9 $mm^2/s$, wherein kinematic viscosity at 100° C. is evaluated according to ASTM D 445.

Preferably, the lubricant composition according to the invention is a cylinder lubricant.

Even more advantageously, the lubricating composition is a cylinder oil for two-stroke diesel marine engines and has a viscosimetric grade SAE-50, equivalent to a kinematic viscosity at 100° C. comprised between 16.3 and 21.9 $mm^2/s$.

Typically, a conventional formulation of cylinder lubricant for two-stroke marine diesel engines is of grade SAE 40 to SAE 60, preferentially SAE 50 (according to the SAE J300 classification) and comprises at least 50% by weight of a lubricating base oil of mineral and/or synthetic origin, adapted to the use in a marine engine, for example of the API Group 1 class.

These viscosities may be obtained by mixing additives and base oils, for example base oils containing mineral bases of Group 1 such as Neutral Solvent (for example 150 NS, 500 NS or 600 NS) bases and bright stock. Any other combination of mineral, synthetic bases or bases of plant origin, having, as a mixture with the additives, a viscosity compatible with the chosen SAE grade, may be used.

The Applicant found that it was possible to formulate cylinder lubricants in which a significant part of the BN is provided by oil-soluble ammonium-based ionic liquid whilst maintaining the level of performance compared with standard formulations with an equivalent BN.

The performances in question here are in particular the capacity to neutralize sulphuric acid, measured using the enthalpy test described in the examples hereafter.

Thanks to the alternative BN provided by the ammonium-based ionic liquid, which do not form hard deposits leading to wear of the parts, optionally in combination with over-based and neutral detergents, the cylinder lubricants according to the present invention are suitable for both high-sulphur fuel oils and low-sulphur fuel oils.

Use of the Ammonium-Based Ionic Liquid of Formula (I) and of the Lubricant Composition Comprising It The invention also relates to the use of an ammonium-based ionic liquid of formula (I) as defined above for lubricating engines, preferably marine engines. Specifically, the invention is directed to the use of an ammonium-based ionic liquid of formula (I) as defined above for lubricating two-stroke marine engines and four-stroke marine engines, more preferably two-stroke marine engine.

In particular, the ammonium-based ionic liquid of formula (I) is suitable for use in a lubricant composition, as cylinder oil or system oil, for lubricating two-stroke engines and four-stroke marine engines, more preferably two-stroke engines.

The invention particularly relates to the use of an ammonium-based ionic liquid of the invention as detergent additive in a lubricant composition, notably a marine lubricant.

In particular, the ammonium-based ionic liquid of formula (I) is used in a lubricant composition, notably a marine lubricant, to reduce and/or limit and/or prevent and/or delay the formation of deposits (keep clean effect) and/or to reduce the deposits already present in the internal parts of a marine engine (clean-up effect).

According to another aspect of the invention, the ammonium-based ionic liquid of the invention is used as an anti-corrosion additive in a lubricant composition, notably a marine lubricant.

The invention also relates to the use of the above-described lubricant composition comprising the ammonium-based ionic liquid of formula (I) and a base oil, for lubricating two-stroke engines and four-stroke marine engines, more preferably two-stroke engines.

In particular, the above-described lubricant composition is used in marine engines, preferably two-stroke marine engines, to reduce and/or limit and/or prevent and/or delay the formation of deposits (keep clean effect) and/or to reduce the deposits already present in the internal parts of said marine engine (clean-up effect).

According to another aspect of the invention, the lubricant composition of the invention is used in a marine engine, preferably a two-stroke marine engine, to reduce and/or limit and/or prevent and/or delay corrosion.

The invention also relates to a method for lubricating two-stroke marine engines and four-stroke marine engines, more preferably two-stroke marine engines, said method comprising the application to said marine engine of the ammonium-based ionic liquid or of a lubricant composition as disclosed above.

The invention particularly relates to a method to reduce and/or limit and/or prevent and/or delay the formation of deposits and/or to reduce the deposits already present in the internal parts of a combustion engine, wherein said method comprises at least a step of application to said engine of an ammonium-based ionic liquid or of a lubricant composition as disclosed above.

The invention also relates to a method to reduce and/or limit and/or prevent and/or delay corrosion in the internal parts of a marine engine, wherein said method comprises at least a step of application to said engine of an ammonium-based ionic liquid or of a lubricant composition as disclosed above.

In particular, the ammonium-based ionic liquid or the lubricant composition is applied to the cylinder wall, typically by a pulse lubricating system or by spraying the ionic liquid or the composition onto the piston's rings pack through an injector for lubricating two-stroke engines. It has been observed that applying to the cylinder wall the lubricant composition according to the invention provides increased protection against corrosion and improved engine cleanliness.

EXAMPLES

Materials and Methods:

Tri-n-octylmethylammonium methylcarbonate (CAS No 488711-07-5) is available from ABCR GmbH.

2-ethylhexanoic acid (CAS No 149-57-5) is available from Merck.

I—Synthesis of Tri-n-Octylmethylammonium 2-Ethylhexanoate (IL1):

To a solution of tri-n-octylmethylammonium methylcarbonate 30% in methanol (1774 g, 4 mol), 576.8 g (4 mol) of 2-ethylhexanoic acid were added slowly and under stirring over a period of 5 hours using a piston pump. The temperature of the reaction was kept under 25° C. $CO_2$ evolution was monitored and stirring was controlled in order to avoid foaming. After completion of the addition, the reaction mixture was stirred at room temperature for 24 hours, then the pH of the medium was adjusted to pH=9 through addition of either tri-n-octylmethylammonium methylcarbonate or 2-ethylhexanoic acid. 60 ml of activated charcoal were added to the mixture and the latter was further vigorously stirred for 13 hours at room temperature. The charcoal was filtrated over a glass frit filter, the solvent evaporated at 38° C. under reduced pressure. The obtained slightly yellow oil was further dried at 35° C. under a vacuum of $10^{-2}$ mbar for 168 hours and under vigorous stirring until the water content was below 0.1%, as measured by Karl-Fischer titration.

The base number of IL1 is 114 mg KOH/g according to ASTM D2896.

Solubility Test:

In order to check that the ammonium-based ionic liquid is oil-soluble, the following test has been achieved:

100 mL of the lubricant composition comprising IL1 and the base oil is introduced into two reaction tubes. One of the tubes is maintained at room temperature (between 15 and 25° C.) and the other reaction tube is placed in an oven at 60° C.

After three months, the lubricant composition of both reaction tubes was limpid. Thus, the prepared ionic liquid IL1 is soluble in the oil.

II—Preparation of the Lubricant Composition:

Lubricant compositions are prepared by mixing the base oil with the additives listed in Table 1 below at 60° C. with the corresponding proportions. The percentages correspond to weight percent with regards to the total weight of the composition.

Composition C1 is a comparative example. Composition C2 is according to the invention.

TABLE 1 formulation of lubricant compositions

| | Composition | |
|---|---|---|
| | C1 | C2 |
| Base oil (1) (%) | 89.67 | 88.4 |
| IL1 (%) | | 2.6 |
| Dtg 1 (2) (%) | 4.6 | 4 |
| Dtg 2 (2) (%) | 5.7 | 5 |
| AF (3) (%) | 0.03 | 0.03 |
| TBN (Total base number in mg KOH/g of composition according to ASTM D2896) | 25.1 | 25.5 |

(1) Group I mineral oil XX having a viscosity at 40° C. of 112 cSt measured according to ASTM D7279

(2) Detergents: Dtg1: Salicylate of TBN = 225 mg KOH/g according to ASTM D2896, Dtg 2: Phenate of TBN = 260 mg KOH/g according to ASTM D2896

(3) AF: anti-foaming agent.

III: Test Method 1—Heat Resistance and Detergency of Lubricant Compositions:

The heat resistance of lubricant compositions according to the invention is evaluated by performing the ECBT test on aged oil.

Principle: the heat resistance of the lubricant composition $C_1$ was thus evaluated by means of the ECBT test on aged oil, via which the mass of deposits (in mg) generated under given conditions is determined. The lower this mass, the better the heat resistance and thus the better the cleanliness of the engine.

This test simulates the behaviour of the lubricant composition when it is injected onto the hot parts of the engine and especially onto the top of the piston.

Equipment used: the test was performed at a temperature of 310° C. It uses aluminium beakers which simulate the form of pistons. The beakers were placed in a glass container; the lubricant composition being maintained at a controlled temperature of about 60° C. The lubricant was placed in these containers, which were themselves equipped with a metal brush partially immersed in the lubricant. This brush is driven in a rotary motion at a speed of 1000 rpm, which creates a projection of lubricant onto the inner surface of the beaker. The beaker was maintained at a temperature of 310° C. by means of a heating electrical resistance, regulated by a thermocouple. This projection of lubricant was continued throughout the test for 12 hours.

This procedure makes it possible to simulate the formation of deposits in the piston-ring assembly. The result is the weight of deposits measured in mg on the beaker.

A detailed description of this test is given in the publication "Research and Development of Marine Lubricants in ELF ANTAR France—The relevance of laboratory tests in simulating field performance" by Jean-Philippe ROMAN, Marine Propulsion Conference 2000-Amsterdam-29-30 Mar. 2000.

Results: the lubricant composition according to the invention C2 provides 110 mg of deposits whereas the comparative lubricant C1 provides 499 mg of deposits.

Thus, the ammonium-based ionic liquid of formula (I) according to the present invention has good detergency properties since it allows reducing the deposits in pieces of a motor.

IV: Test Method 2—Anti-Corrosion Properties:

Equipment used: The apparatus used to evaluate the passivation of the compounds tested consists of a beaker of suitable size (usually 500 to 1000 mL), a temperature-regulating device such as a hot plate, and a specimen support system. 200 mL of lubricant are continuously mixed by a suitable stirring mechanism, such as a magnetic stirrer or others. Using a dosing syringe or pump, a well-defined amount of sulfuric acid is added to the lubricant drop by drop, to expose the metallic test samples to severely acidic corrosive conditions. The quantity of sulfuric acid is determined to have 90% of the TBN of the oil neutralized.

The effects of corrosion are determined by visual changes on the metallic specimen.

Results: The results obtained with compositions C1 and C2 described above are shown in table 3 below. Corrosion is rated on a scale of 1 to 5.

1 means that the test sample is very corroded and 5 means it is hardly corroded or not corroded at all.

TABLE 3

| | Composition | |
|---|---|---|
| | C1 | C2 |
| Corrosion observed | 1 | 5 |

The invention claimed is:

1. A method to reduce and/or limit and/or prevent and/or delay the formation of deposits or to reduce the deposits already present in the internal parts of a marine combustion engine, the method comprising at least a step of application to said engine of an ammonium-based ionic liquid compound of formula (I)

$$[CAT^+][X^-] \quad (I)$$

wherein $[CAT^+]$ is tri-n-octylmethylammonium and $[X^-]$ is selected from compounds of formula (IA):

(IA)

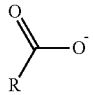

wherein R is selected from linear or branched alkyl and alkenyl groups comprising from 2 to 7 atoms of carbon.

2. The method according to claim 1 wherein in formula (IA) R represents a linear or branched alkyl group comprising from 2 to 7 atoms of carbon.

3. The method according to claim 2 wherein in formula (IA) R represents a linear or branched alkyl group comprising from 4 to 7.

4. The method according to claim 3 wherein R represents a linear or branched alkyl group comprising from 5 to 7 carbon atoms.

5. The method according to claim 4 wherein $[X^-]$ is 2-ethylhexanoate.

6. The method according to claim 1, wherein the ammonium-based ionic liquid compound of formula (I) is applied in a lubricant composition comprising:

from 30.0 to 99.95% of at least one base oil, from 0.05 to 15.0% of ammonium-based ionic liquid compound of formula (I).

7. A lubricant composition comprising:

from 30.0 to 94.0% of at least one base oil, from 0.05 to 15% of at least one ammonium-based ionic liquid of formula (I), $$[CAT^+][X^-] \quad (I)$$

wherein $[CAT^+]$ is tri-n-octylmethylammonium and $[X^-]$ is selected from compounds of formula (IA):

(IA)

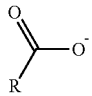

wherein R is selected from linear or branched alkyl and alkenyl groups comprising from 2 to 7 atoms of carbon, and from 1 to 35% of at least one detergent selected from neutral and overbased detergents, other than the ionic liquid, having a Total Base Number according to ASTM D2896 of from 20 to 450 mg KOH/g the percentages being defined by weight of component as compared to the total weight of the composition.

8. The lubricant composition according to claim 7, wherein the percentage by weight of ammonium-based ionic liquid relative to the total weight of lubricant composition is selected such that a total base number provided by the ammonium-based ionic liquid represents at least 3% of an overall total base number of the lubricant composition.

9. The lubricant composition according to claim 7, wherein the percentage by weight of ammonium-based ionic liquid of formula (I) is selected such that a total base number provided by the compounds of formula (I) represents a contribution of at least 0.5 milligrams of potash per gram of lubricant an overall total base number of the lubricant composition.

10. The lubricant composition according to claim 7, which has a Total Base Number (TBN) value according to ASTM D2896 of above 5 mg KOH/g.

11. The lubricant composition according to claim 7, which has a kinematic viscosity at 100° ° C. superior or equal to 5.6 $mm^2/s$ and inferior or equal to 21.9 $mm^2/s$.

12. A lubricant composition comprising:

from 30.0 to 99.95% of at least one base oil, from 0.05 to 15.0% of tri-n-octylmethylammonium 2-ethylhexanoate, the percentages being defined by weight of component as compared to the total weight of the composition.

13. The lubricant composition according to claim 12, wherein it comprises at least one detergent selected from neutral and overbased detergents, other than the ionic liquid, having a Total Base Number according to ASTM D2896 of from 20 to 450 mg KOH/g.

* * * * *